US008191634B2

(12) United States Patent
Xu

(10) Patent No.: US 8,191,634 B2
(45) Date of Patent: Jun. 5, 2012

(54) MAGNETIC FLAPPER SHOCK ABSORBER

(75) Inventor: Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 300 days.

(21) Appl. No.: 12/468,103

(22) Filed: May 19, 2009

(65) Prior Publication Data

US 2010/0294502 A1 Nov. 25, 2010

(51) Int. Cl.

| | |
|---|---|
| ***E21B 34/00*** | (2006.01) |
| ***E21B 34/08*** | (2006.01) |
| ***E21B 43/00*** | (2006.01) |
| ***F16K 1/18*** | (2006.01) |
| ***F16K 1/20*** | (2006.01) |

(52) U.S. Cl. ..... 166/332.8; 166/66.5; 166/386

(58) Field of Classification Search ..... 188/266, 188/267–267.2; 166/66.5, 332.8; 137/514; 251/64, 65

See application file for complete search history.

(56) References Cited

U.S. PATENT DOCUMENTS

| | | | | |
|---|---|---|---|---|
| 3,004,309 | A * | 10/1961 | Korodi | 49/478.1 |
| 4,436,109 | A | 3/1984 | Taylor | |
| 4,577,657 | A * | 3/1986 | Alexander | 137/448 |
| 5,209,454 | A | 5/1993 | Engdahl et al. | |
| 5,752,879 | A | 5/1998 | Berdut | |
| 5,970,801 | A | 10/1999 | Ciobanu et al. | |
| 6,315,047 | B1 * | 11/2001 | Deaton et al. | 166/319 |
| 7,021,386 | B2 * | 4/2006 | Vick et al. | 166/332.8 |
| 7,527,069 | B2 | 5/2009 | Denike et al. | |
| 7,703,532 | B2 | 4/2010 | O'Malley et al. | |
| 7,762,521 | B2 * | 7/2010 | Brun et al. | 251/64 |
| 7,814,974 | B2 | 10/2010 | Sponchia | |
| 7,819,190 | B2 | 10/2010 | Sponchia | |
| 7,931,081 | B2 | 4/2011 | Sponchia | |
| 2004/0211422 | A1 * | 10/2004 | Arcilla et al. | 128/204.19 |
| 2006/0157240 | A1 * | 7/2006 | Shaw et al. | 166/255.1 |
| 2008/0157014 | A1 * | 7/2008 | Vick et al. | 251/65 |
| 2009/0032238 | A1 * | 2/2009 | Rogers et al. | 166/66.6 |
| 2009/0071654 | A1 * | 3/2009 | O'Malley et al. | 166/323 |

OTHER PUBLICATIONS

Leboeuf, Gerald, et al., "Case History: New Design in Surface-Controlled Subsurface Safety Valves Resolves Valve Problems in Subsea Completions in the Gulf of Mexico", OTC 19620, May 2008, 1-9.

Vinzant, Mike, et al, "Enhanced Reliability wiht Unique Tubing-Retrievable Safety Valve Design", SPE 88627, Oct. 2004, 1-7.

Vinzant, Mike et al., "A Unique Design for Deep-Set Tubing-retrievable Safety Valves Increases Their Integrity in Ultra Deepwater Applications", SPE 90721, Sep. 2004, 1-9.

Vick, J., et al., Unique Safety Valve Design Using a Floating Magnetic Coupler and Metal-to-Metal Sealing Capability to Provide Step-Change Improvements in Reliability, Safety, and Cost, OTC 17455, May 2005, 1-8.

* cited by examiner

*Primary Examiner* — Cathleen Hutchins
(74) *Attorney, Agent, or Firm* — Steve Rosenblatt

(57) ABSTRACT

A flapper in a subsurface safety valve has at least one magnet that comes in close proximity with another magnet mounted in a fixed position on the valve body. There is a fixed magnet on the body adjacent to the fully open and the fully closed positions of the flapper. In each case like poles on the flapper magnet and the housing magnet come in close proximity as the flapper reaches its fully open and fully closed positions. The orientation of like poles adjacent each other creates a repelling force that damps or eliminates shock loading.

20 Claims, 2 Drawing Sheets

MAGNETIC FLAPPER SHOCK ABSORBER

FIELD OF THE INVENTION

The field of this invention is tools used in a subterranean formation that have a movable component that is subjected to shock loading and the use of a field to cushion impact loads and more particularly using a magnetic field to control shock loading on a flapper of a subsurface safety valve.

BACKGROUND OF THE INVENTION

Magnets have been used to act as dampeners such as in the context of exercise equipment as illustrated in U.S. Pat. No. 5,752,879. Magnets have been used in fluid flow systems to hold a position of a moving component such as for example in an open or a closed position. Illustrative of a gas line and a medical device application are U.S. Pat. No. 5,209,454 and U.S. Pat. No. 5,970,801. In a similar vein is U.S. Pat. No. 7,527,069. The use of magnets to control the fixation of a movable member in a level control application is seen in U.S. Pat. No. 4,436,109. These disparate applications seek to use the force of a magnetic field for fixation to a given position. Some of them release the component when the magnetic field is deactivated.

In downhole applications and most particularly in valves where large pressure differentials can build in an instant as a valve member such as a flapper moves against a seat, there can be serious damage from the impact force that can be severe enough to deform the valve member or the mating seat. In the case of subsurface safety valve flappers, when opened but more so when allowed to close, there is a risk of flapper or seat damage or damage to both from a severe impact loading. Accordingly the present invention seeks to cushion or even eliminate the shock contact while still allowing the movable member to reach its intended ultimate position. In the context of a flapper, the preferred embodiment locates at least one magnet on the flapper and magnets in the housing adjacent the location of the flapper when it reaches its ultimate open or closed position. In this manner the application of a magnetic field to the pivoting flapper damps any impact with the seat in the closed position and any travel stop for the open position. These and other features of the present invention will be more apparent to those skilled in the art from a review of the description of the preferred embodiment and the associated FIGS. while recognizing that the full scope of the invention is given by the appended claims.

SUMMARY OF THE INVENTION

A flapper in a subsurface safety valve has at least one magnet that comes in close proximity with another magnet mounted in a fixed position on the valve body. There is a fixed magnet on the body adjacent to the fully open and the fully closed positions of the flapper. In each case like poles on the flapper magnet and the housing magnet come in close proximity as the flapper reaches its fully open and fully closed positions. The orientation of like poles adjacent each other creates a repelling force that damps or eliminates shock loading.

DETAILED DESCRIPTION OF THE PREFERRED EMBODIMENT

Figure 1:
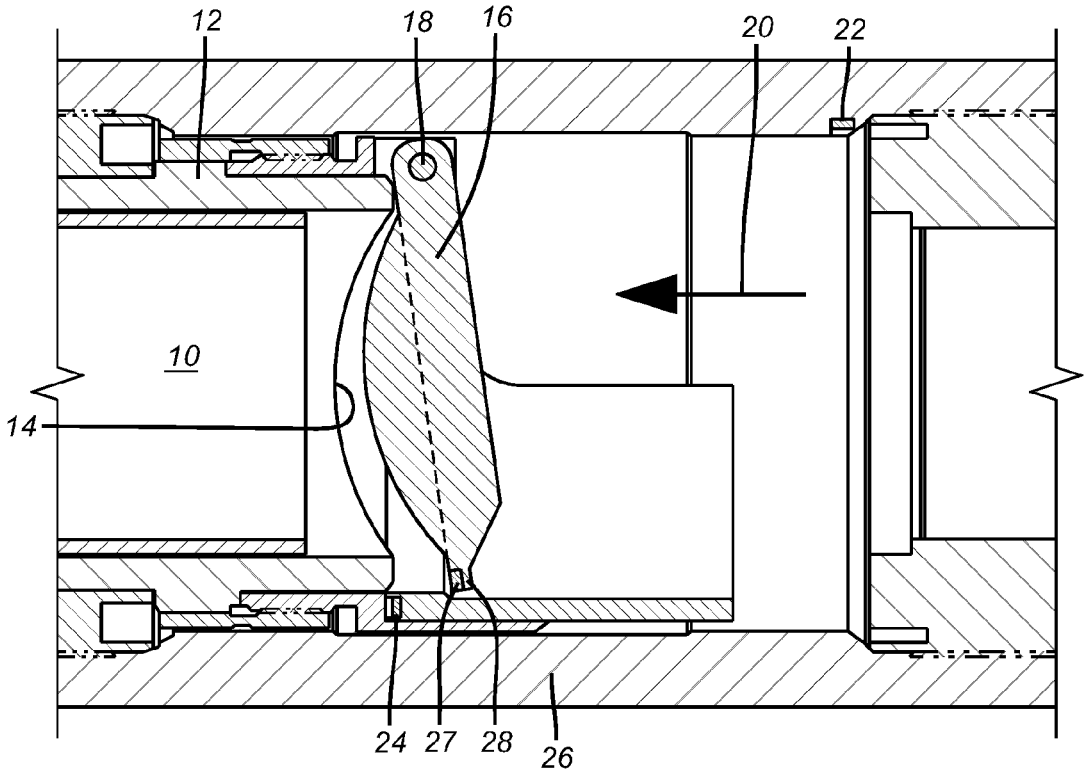
FIG. 1 is a section view of a flapper in a safety valve just about to close.

The basic structure of a downhole subsurface safety valve is known to those skilled in the art. Basically, a hydraulic control line runs from the surface to the valve to operate a piston that is biased against the applied pressure in the control line. Pressurizing the control line moves the piston which is linked for tandem movement with a flow tube 10. The flow tube 10 rides inside seat assembly 12 the lower end of which has a seat 14. A flapper 16 is pivoted at 18 and the pivot shaft can have a spring to bias the flapper 16 into the closed position of FIG. 3 when the pressure on the control line is removed and a closure spring pushes the piston in an opposed direction which has the effect of retracting the flow tube 10 at which point the spring on the pivot 18 initiates movement of the flapper 16 toward seat 14. The flow trying to come uphole as represented by arrow 20 helps to get the flapper 16 moving toward its seat 14. The seat 14 and the corresponding portion of the flapper 16 that lands on seat 14 are complex contoured shapes that are expensive to produce in computer controlled milling machines. It is very undesirable to get any deformation in the seat 14 or in the mating portion of the flapper 16.

Figure 2:
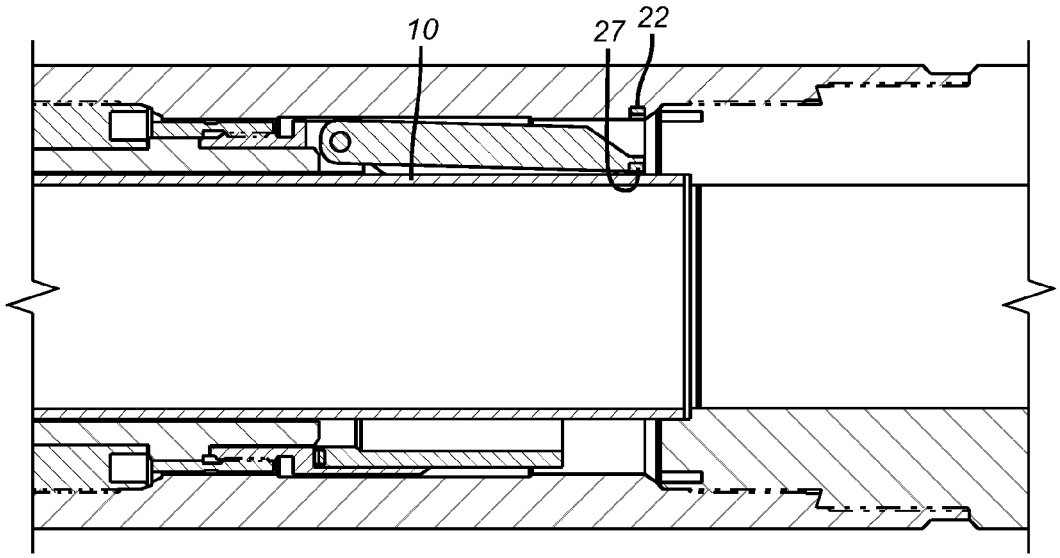
FIG. 2 is the view of FIG. 1 with the flapper in the fully open position.
Figure 3:
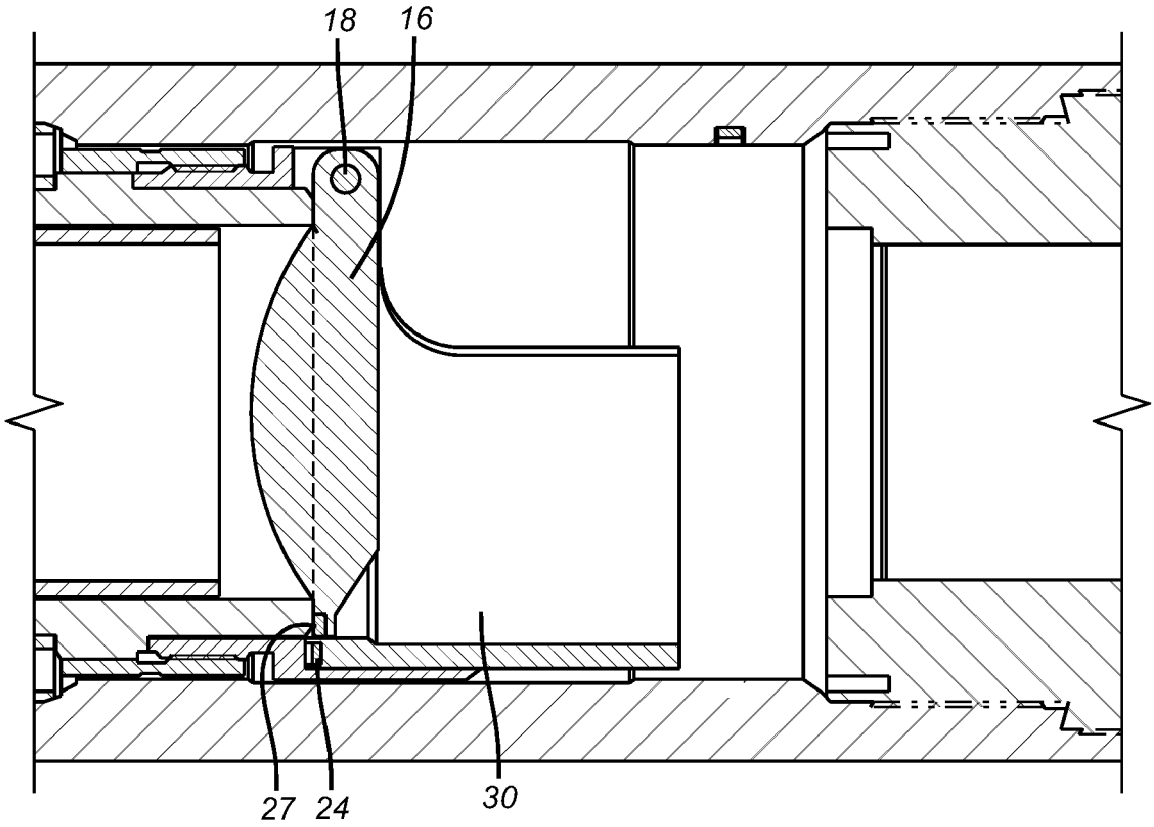
FIG. 3 is the view of FIG. 2 with the flapper in the fully closed position.

Those skilled in the art will see that as the flow tube 10 is retracted and the flapper starts movement from the FIG. 2 to the FIG. 1 to the FIG. 3 positions, the velocity of the fluid represented by arrow 20 can result in slamming the conforming shapes of the seat 14 and the flapper 16 against each other. In the preferred embodiment, the use of a force of a magnetic field is designed to reduce the velocity of the rotating flapper 16 as it reaches the fully closed FIG. 3 position and the fully open FIG. 2 position.

The way the dampening is accomplished in the preferred embodiment is to fixedly mount a permanent magnet 22 and 24 in the housing 26 and a magnet 27 to the flapper 16 on an extending tab 28. Tab 28 is preferably diametrically opposed from the location of the pivot connection 18. The opposing surfaces of magnets 24 and 27 are of the same polarity so that they repel each other as they get closer together. The same can be said for magnets 22 and 27 as they approach each other when the flapper 16 goes toward the open position of FIG. 2. The end tab 28 is used to allow the magnets 24 and 27 to be away from the specially machined complementary surfaces that engage when the flapper 16 engages the seat 14. It is cheaper to do it this way than to drill blind bores in the flapper and seat sealing surfaces although to do so can be an alternative way to use the magnets 24 and 27 to provide a dampening of the velocity and the resulting momentum force as the flapper 16 goes to the closed position of FIG. 3. As shown in FIG. 3 magnet 24 is on a longer radius from pivot 18 than magnet 27 which still allows taking advantage of like poles repelling each other. The orientation can also be changed to position magnet 27 on the same arc as magnet 24 to create the dampening effect of magnets repelling each other. However, the offset orientation allows taking advantage of the repelling force when magnets 24 and 27 get close enough to each other, as shown in FIG. 1, and then deliberately reducing or eliminating the repelling force having already slowed the flapper 16 when the magnets 24 and 27 go side by side as shown in FIG. 3. In this configuration the flapper can seat within 5 seconds as required in Standard 14A of the American Petroleum Institute (API). The relative positions can be varied to take into account ease of assembly, cost, power of the magnets to repel each other and the size and weight of the flapper 16.

The overarching concept is the use of a field to reduce the velocity of a moving component in a downhole tool. From there the focus can get more specific to the use of a magnetic field and on down to permanent magnets and their relative positions in the open position of FIG. 2 and the closed position of FIG. 3.

It should also be noted that introducing high pressure and high velocity gas in a downhole direction which is the reverse of arrow 20 from above a closed flapper 16 can accelerate the flapper 16 to the open position of FIG. 2 with enough force to also cause potential damage. Clearly there is greater risk of damage in the flapper 16 going to the closed position of FIG. 3. However, magnet pair 22 and 27 serves to slow down the flapper 16 as it starts to slam to the fully open position. Again with this magnet pair there can be an axial offset between them in the direction of arrow 20 or the arc of magnet 27 can coincide with the location of magnet 22.

Magnet pair 22 and 27 also prevent another problem. Sometimes when the flow tube 10 is raised by the control system (not shown) high velocity gas gets behind the flapper 16 in the open position and creates a low pressure zone behind the flapper 16 that in extreme cases holds the flapper in the open position where it needs to go to the closed position. The magnet pair 22 and 27 can provide a repelling force to drive the flapper 16 toward the closed position. To do this the preferred orientation of this pair of magnets is alignment. The flow tube 10 will push the flapper out of the way when going to the open position so alignment of this magnet pair is not an issue even if the repelling force does not diminish since the force behind the moving flow tube will overcome the repelling force in any event. The magnet 22 can optionally be eliminated.

While more complicated, one or more of the magnets can be powered electromagnets that can be selectively powered or turned off from a location removed from the valve. Other electrical fields are contemplated that can create a repelling force. It should be noted that the flapper momentum by definition overcomes the repelling force while it is being decelerated with the repelling force diminishing or going to zero when the magnets 24 and 27 get toward a radially aligned position shown in FIG. 3, so that the force of pressure on the flapper 16 in the closed position will tightly hold the closed position of FIG. 3. It is even possible to have the magnets attract in the FIG. 3 position by having opposite poles close enough to each other to aid in holding flapper 16 in the closed position. In the open position the flow tube 10 holds back the flapper 16 and overcomes any repelling force as magnets 22 and 27 get close to each other.

The above description is illustrative of the preferred embodiment and many modifications may be made by those skilled in the art without departing from the invention whose scope is to be determined from the literal and equivalent scope of the claims below:

I claim:

1. A shock absorbing apparatus for a movable component in a subterranean tool, comprising:

a body;

the movable component in said body having at least one position where movement of said movable component is stopped by contact with said body;

a magnetic force field acting on said movable component to reduce the velocity of said movable component prior to said contact with said body; wherein said movable component comprises a flapper and said body comprises a flapper seat assembly in a subsurface safety valve.

2. The apparatus of claim 1, wherein:

said force field is created with magnets oriented to repel each other.

3. The apparatus of claim 1, wherein:

at least a first one of said magnets is mounted to said component.

4. The apparatus of claim 3, wherein:

at least a second one of said magnets is mounted to said housing.

5. The apparatus of claim 4, wherein:

said second magnet is offset or aligned with the path of movement of said first magnet.

6. The apparatus of claim 5, wherein:

the path of movement of said first magnet is an arc.

7. The apparatus of claim 6, wherein:

said flapper and said seat assembly have complementary sealing surfaces;

said magnets are disposed in or at a spaced relation to said sealing surfaces.

8. The apparatus of claim 7, wherein:

said first and second magnets are radially offset when said sealing surfaces are in contact.

9. The apparatus of claim 8, wherein:

said first magnet is supported on a peripheral tab on said flapper.

10. The apparatus of claim 9, wherein:

said flapper pivots on a pinned connection to said seat assembly;

said first magnet is mounted diametrically opposed to said pinned connection.

11. The apparatus of claim 6, wherein:

said flapper pivots from a closed position where said sealing surfaces are in contact to an open position where said flapper is rotated about 90 degrees;

said at least one second magnet comprises a plurality of magnets with at least one located adjacent said sealing surface and another located in said body in proximity to said first magnet when said flapper moves to said open position.

12. The apparatus of claim 11, wherein:

the magnet pairs slow the velocity of said flapper when moving toward said open and its closed positions of said flapper.

13. The apparatus of claim 6, wherein:

said second magnet is offset from the arcuate path of said first magnet so as to increase a repelling force on said movable component as said magnets approach followed by a decrease in the repelling force as said first and second magnets come into a radially aligned position.

14. The apparatus of claim 13, wherein:

said first and second magnets are positioned to create an attracting force to each other when radially aligned after said decrease in the repelling force.

15. The apparatus of claim 2, wherein:

said magnets are permanent magnets or electromagnets.

16. The apparatus of claim 1, wherein:

said flapper and said seat assembly have complementary sealing surfaces;

said force field comprises magnets that are disposed in or at a spaced relation to said sealing surfaces.

17. The apparatus of claim 16, wherein:

said first and second magnets are radially offset when said sealing surfaces are in contact.

18. The apparatus of claim 17, wherein:

said flapper pivots from a closed position where said sealing surfaces are in contact to an open position where said flapper is rotated about 90 degrees;

said at least one second magnet comprises a plurality of magnets with at least one located adjacent said sealing surface and another located in said body in proximity to said first magnet when said flapper moves to said open position.

19. The apparatus of claim 18, wherein:

said first magnet on said flapper aligned with said second magnet on said housing that is disposed adjacent said flapper in the open position so as to decelerate said flapper when moving toward said open position and to provide a force to move said flapper to said closed position when said flapper is permitted to move to said closed position.

20. The apparatus of claim 1, wherein:

said force field is created with magnets oriented to repel each other;

at least a first one of said magnets is mounted to said component;

at least a second one of said magnets is mounted to said housing;

said flapper pivots from a closed position where said sealing surfaces are in contact to an open position where said flapper is rotated about 90 degrees;

said at least one second magnet comprises a plurality of magnets with at least one located adjacent said sealing surface and another located in said body in proximity to said first magnet when said flapper moves to said open position.

* * * * *